US009744399B2

(12) United States Patent
Sheeler et al.

(10) Patent No.: US 9,744,399 B2
(45) Date of Patent: Aug. 29, 2017

(54) EXERCISE MACHINE

(71) Applicants: Jason Sheeler, Burbank, CA (US); Anthony Sheeler, Burbank, CA (US)

(72) Inventors: Jason Sheeler, Burbank, CA (US); Anthony Sheeler, Burbank, CA (US)

(73) Assignees: Jason Sheeler, Burbank, CA (US); Anthony Sheeler, Burbank, CA (US)

( * ) Notice: Subject to any disclaimer, the term of this patent is extended or adjusted under 35 U.S.C. 154(b) by 14 days.

(21) Appl. No.: 14/970,111

(22) Filed: Dec. 15, 2015

(65) Prior Publication Data

US 2016/0166874 A1 Jun. 16, 2016

Related U.S. Application Data

(60) Provisional application No. 62/091,900, filed on Dec. 15, 2014, provisional application No. 62/201,231, filed on Aug. 5, 2015.

(51) Int. Cl.

| | |
|---|---|
| ***A63B 23/12*** | (2006.01) |
| ***A63B 21/16*** | (2006.01) |
| ***A63B 1/00*** | (2006.01) |
| ***A63B 21/068*** | (2006.01) |
| ***A63B 21/00*** | (2006.01) |
| ***A63B 23/02*** | (2006.01) |

(52) U.S. Cl.

CPC ..... *A63B 21/1627* (2013.01); *A63B 1/00* (2013.01); *A63B 21/00047* (2013.01); *A63B 21/068* (2013.01); *A63B 21/1636* (2013.01); *A63B 21/4035* (2015.10); *A63B 23/0216* (2013.01); *A63B 23/1218* (2013.01); *A63B 23/1227* (2013.01); *A63B 2210/50* (2013.01)

(58) Field of Classification Search

CPC ..... A63B 21/1627; A63B 21/068; A63B 21/1636; A63B 21/4035; A63B 21/00047; A63B 1/00; A63B 2210/50; A63B 23/1218; A63B 23/0216; A63B 23/1227

See application file for complete search history.

(56) References Cited

U.S. PATENT DOCUMENTS

2012/0046150 A1* 2/2012 Stacey ..... A63B 1/00 482/131

* cited by examiner

*Primary Examiner* — Loan H Thanh
*Assistant Examiner* — Rae Fischer
(74) *Attorney, Agent, or Firm* — Hahn Loeser & Parks, LLP

(57) ABSTRACT

The present invention relates to an exercise machine that has all the functionality of a standing, bulky, multifunctional exercise machine, but can be mounted on a door frame so that it can quickly and conveniently change from full exercise functionality to full doorway functionality without any removal or disassembly of any components.

13 Claims, 9 Drawing Sheets

EXERCISE MACHINE

CROSS REFERENCE TO RELATED APPLICATIONS

This application claims priority to U.S. Provisional Patent Application No. 62/091,900, filed Dec. 15, 2014 and U.S. Provisional Patent Application No. 62/201,231, filed Aug. 5, 2015, the entire contents of which are hereby incorporated by reference herein.

FIELD OF THE INVENTION

The invention disclosed herein generally relates to a door mounted, multifunctional fitness equipment.

BACKGROUND

Standing multifunctional machines are obtrusive and require a dedicated floor space area for usage and storage.

Door mounted machines that provide similar functionality require disassembly before regaining normal doorway function.

Presently, there is no solution for a door mounted, multifunctional exercise machine that can be used and then moved quickly and conveniently to regain normal doorway function.

The present invention provides solutions to these problems by providing an exercise machine that has all the functionality of a standing, bulky, multifunctional exercise machine, but can be mounted on a door frame so that it can quickly and conveniently change from full exercise functionality to full doorway functionality without any removal or disassembly of any components.

SUMMARY

Embodiments of the invention provide fitness equipment including a pull-up bar. The fitness equipment can include a pull-up bar, two support towers for mounting vertically along the length of a door frame. The support towers can have through holes for the pull-up bar. The support towers can rotate around and slide along the pull-up bar.

The pull-up bar of the invention can include a rectangular bar that runs horizontally and attaches to the backside of the door frame, two parallel vertical bars attached to the rectangular bar, a second horizontal bar attached to the vertical bars and attached to the support towers, and a third horizontal bar attached to the vertical bars. The third horizontal bar can be weight-bearing for exercises.

In some embodiments, the two vertical bars have alignment holes. A pin can fit though the alignment holes to secure the vertical bars to the rectangular bar. The position of the two vertical bars relative to the rectangular bar can be adjustable.

The support towers can include a dampening material on the back side of the support tower mounted to the door frame.

The second horizontal bar and support towers can have alignment holes. A pin can fit through the alignment holes to secure the second horizontal bar to the support towers.

The fitness equipment can further include pivot bars and a support harness bar that create a general "u" shape that is perpendicular to the door frame when equipment is in use and the combined "u" shape can fold vertically when equipment is not in use. The pivot bars can have alignment holes. Pins can fit through the alignment holes to secure the pivot bars to the support towers.

In some embodiments, the support towers can have through holes for the pivot bars. The support towers can rotate around and slide along the pivot bars.

The fitness equipment can include a support harness bar connected to the pivot bars for weight bearing exercises. In some embodiments, the support harness bar is connected to support harnesses. The support harnesses can include a material selected from the group consisting of a woven material, chain link, rope, cord and cable. In some embodiments, the support harnesses connected to the support harness bar are also connected to the pull-up bar.

In some embodiments, the support harness bar and pull-up bar comprise friction-increasing material to secure the support harnesses to the bars. The fitness equipment can also include padding to protect a user during various exercises.

The support harnesses can connect to the top of the fitness equipment so that a load put on the pivot bars is supported in tension by the support harnesses.

BRIEF DESCRIPTION OF THE DRAWINGS

Those of skill in the art will understand that the drawings, described below, are for illustrative purposes only. The drawings are not intended to limit the scope of the present teachings in any way.

DETAILED DESCRIPTION OF THE INVENTION

Unless otherwise noted, terms are to be understood according to conventional usage by those of ordinary skill in the relevant art.

The present invention relates to an exercise machine that has all the functionality of a standing, bulky, multifunctional exercise machine, but can be mounted on a door frame so that it can quickly and conveniently change from full exercise functionality to full doorway functionality without any removal or disassembly of any components.

In some embodiments, the exercise machine can fold down from a door frame mounted pull-up bar to support the execution of other exercises. In some embodiments, the product can easily fold back into itself for minimally obtrusive doorway functionality. In some embodiments, the product can also be used as a pull up bar with smaller support towers. In some embodiments, the product can also be completely removed for quick storage in less space than traditional standing multifunctional exercise equipment.

Having described the invention in detail, it will be apparent that modifications, variations, and equivalent embodiments are possible without departing from the scope of the invention defined in the appended claims. Furthermore, it should be appreciated that all examples in the present disclosure are provided as non-limiting examples.

The following non-limiting examples are provided to further illustrate embodiments of the invention disclosed herein. It should be appreciated by those of skill in the art that the techniques disclosed in the examples that follow represent approaches that have been found to function well in the practice of the invention, and thus can be considered to constitute examples of modes for its practice. However, those of skill in the art should, in light of the present disclosure, appreciate that many changes can be made in the specific embodiments that are disclosed and still obtain a like or similar result without departing from the spirit and scope of the invention.

Use with Standard Pull-Up Bar

Figures 1A, 1D:
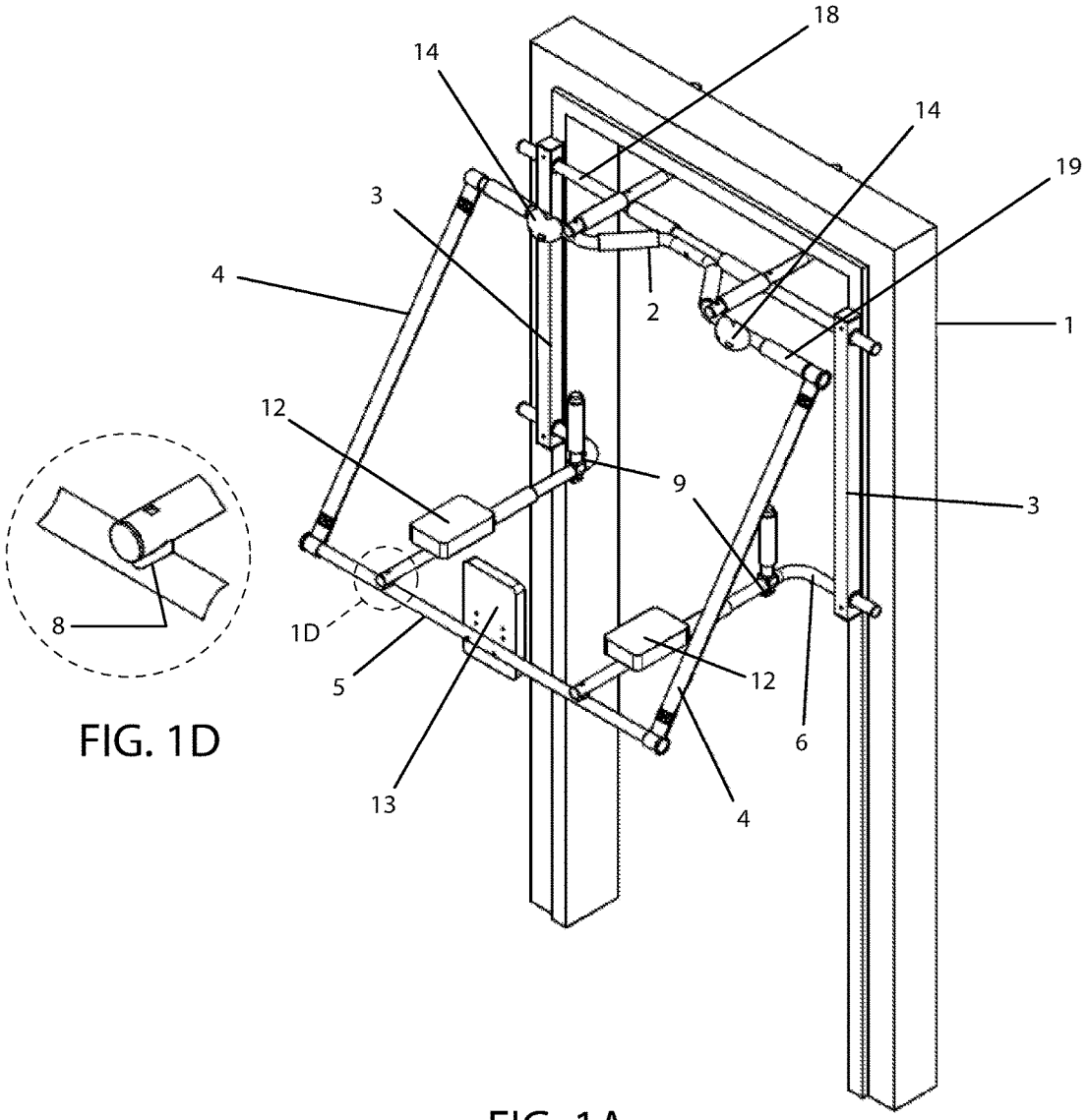
FIGS. 1A-1E depict the exercise machine attached to a door frame in its lowered position.
Figure 1E:
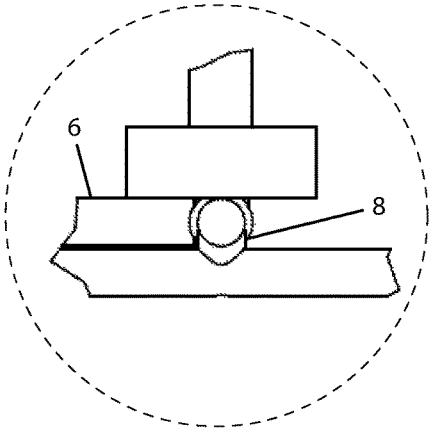
Figure 1B:
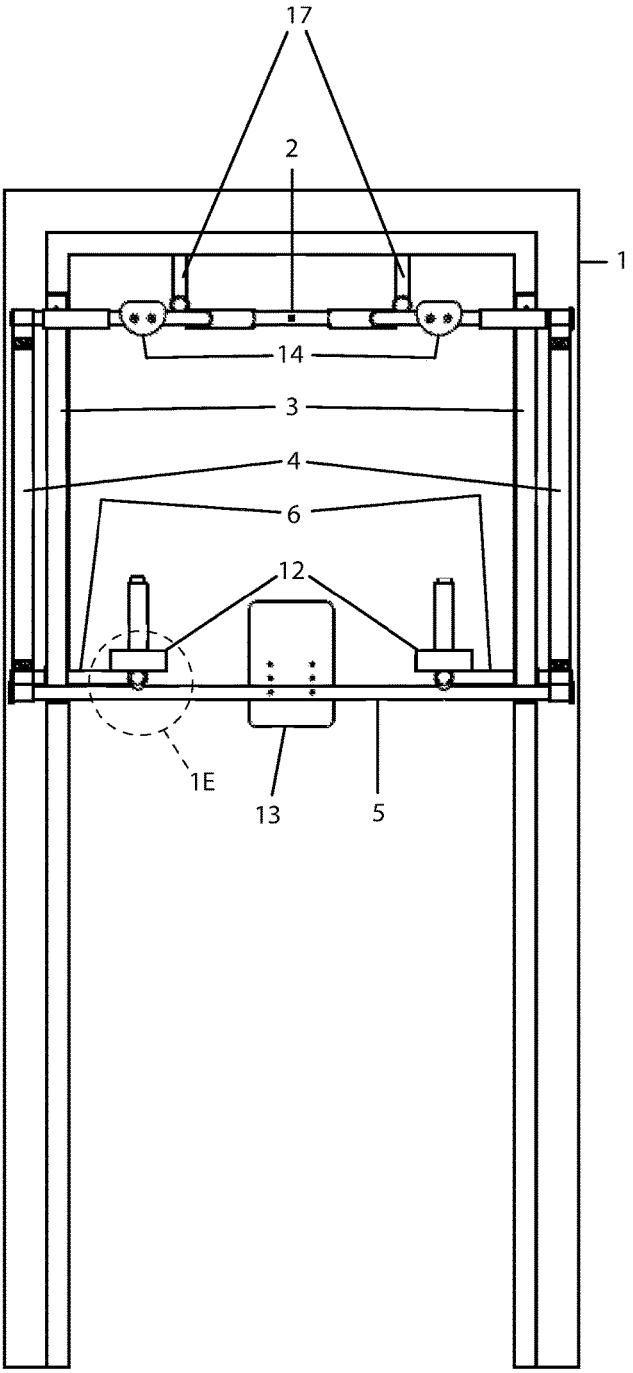
Figure 1C:
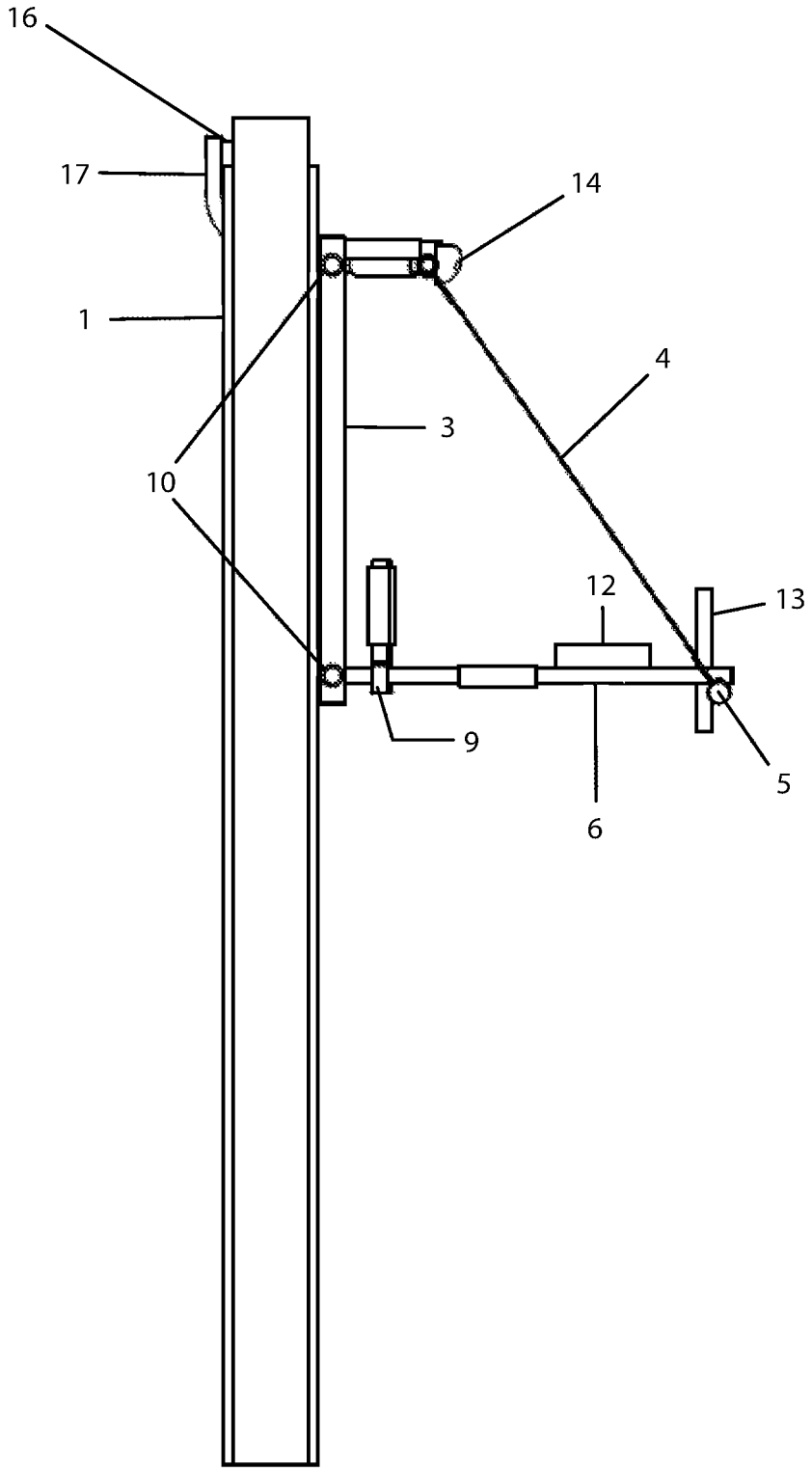
Figure 2A:
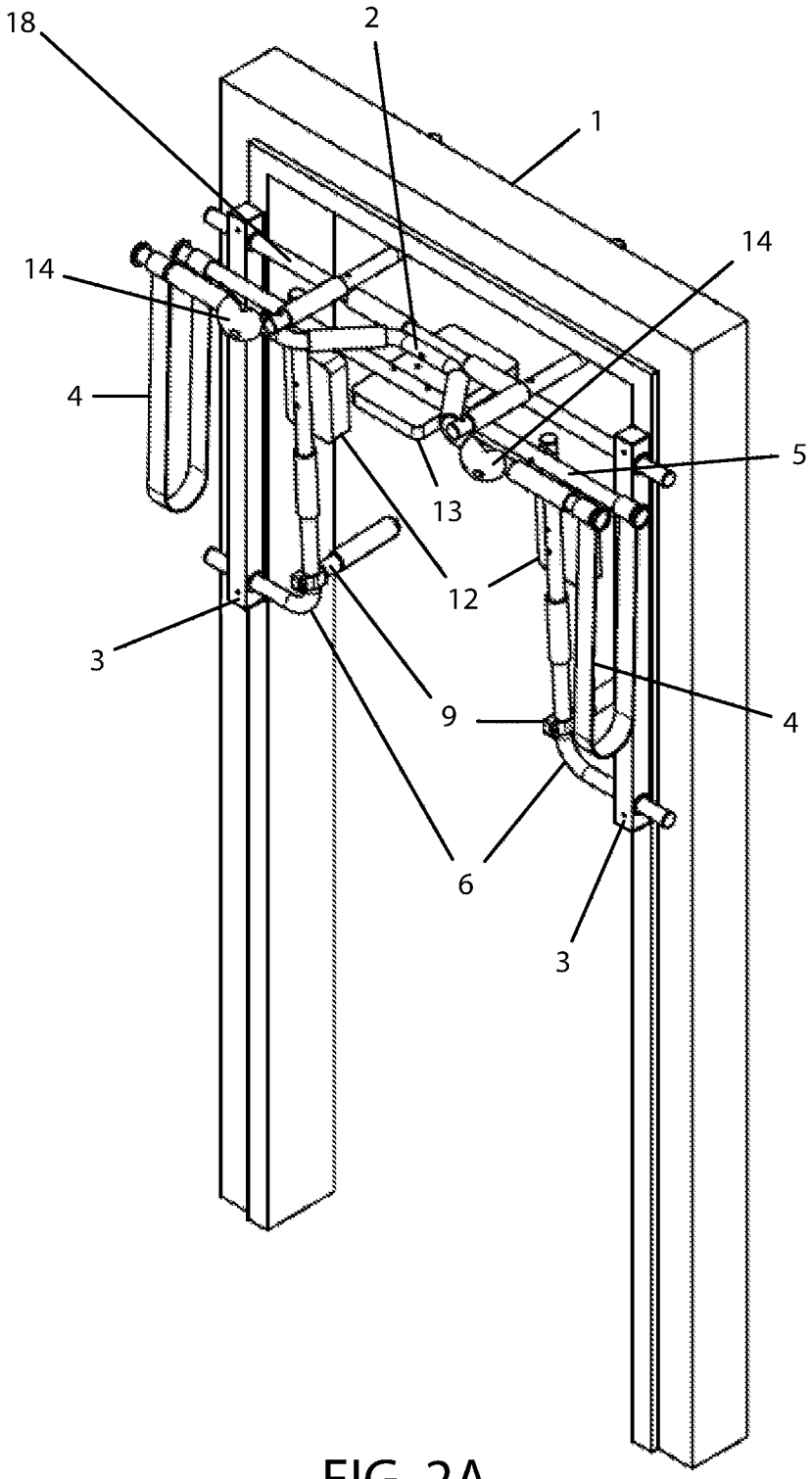
FIGS. 2A, 2B, 2C depict the exercise machine attached to a door frame in its folded position.
Figure 2B:
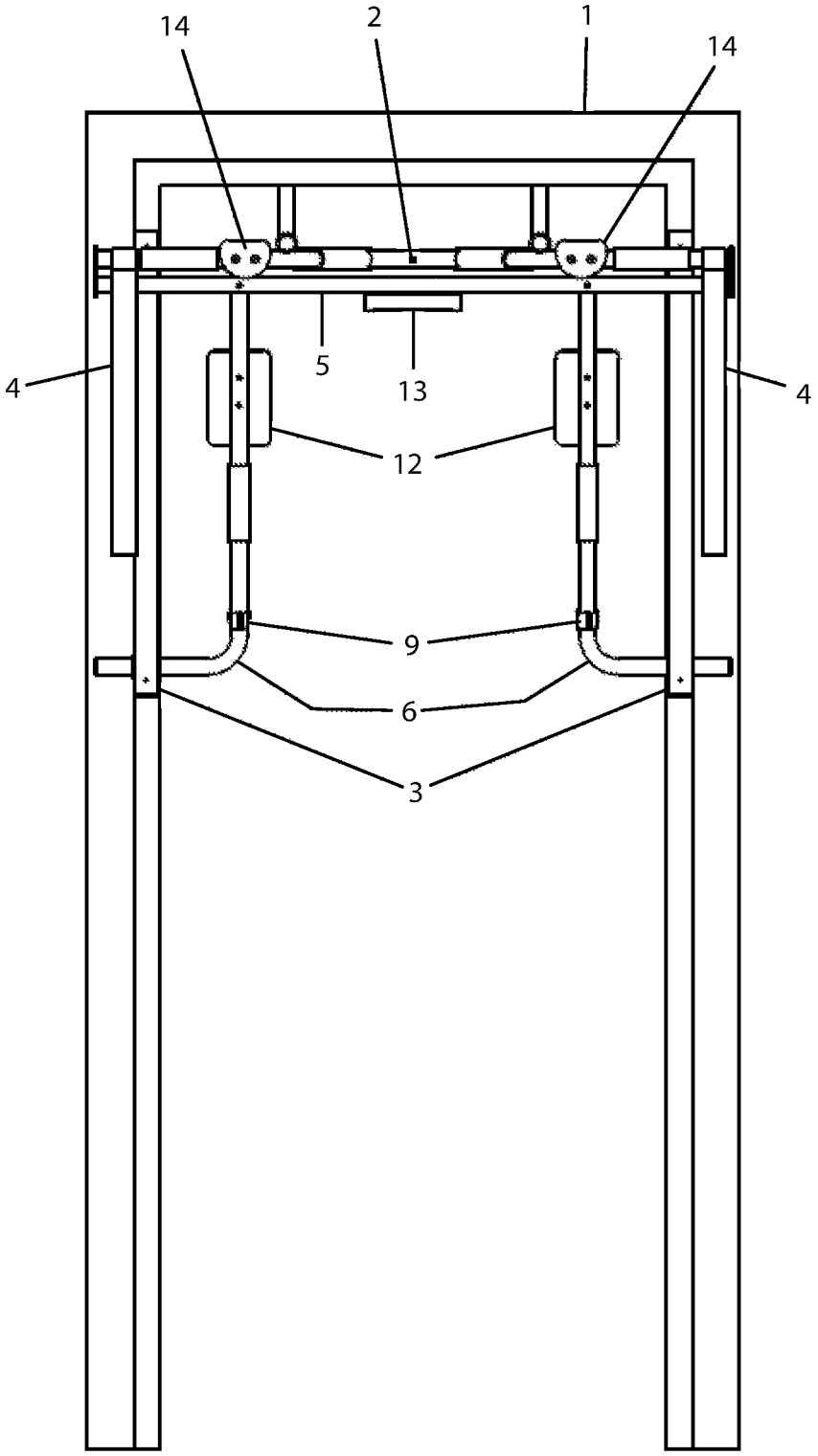
Figure 2C:
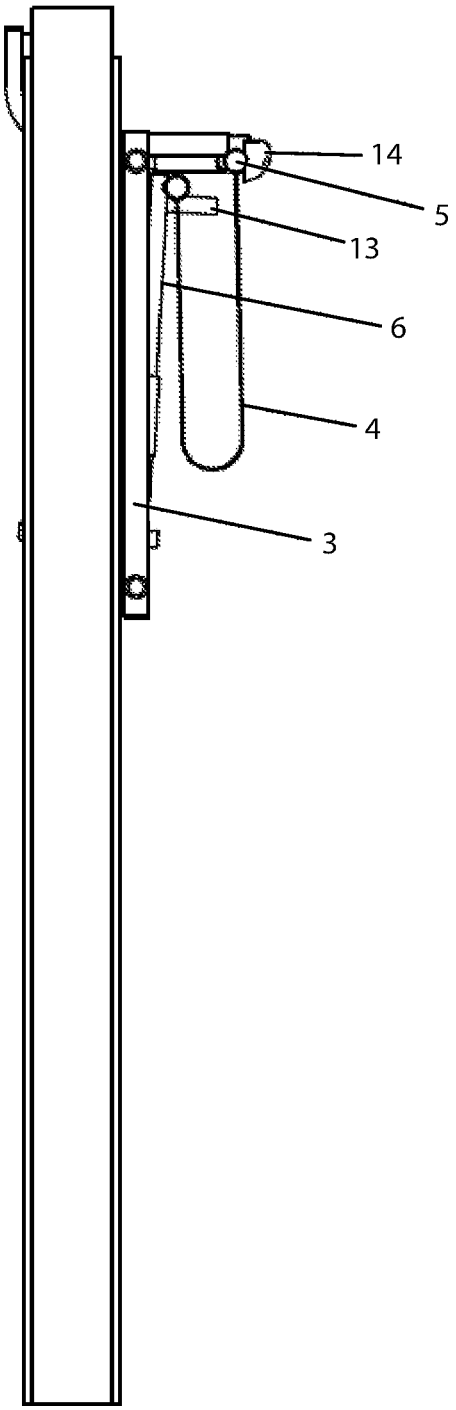
Figure 3B:
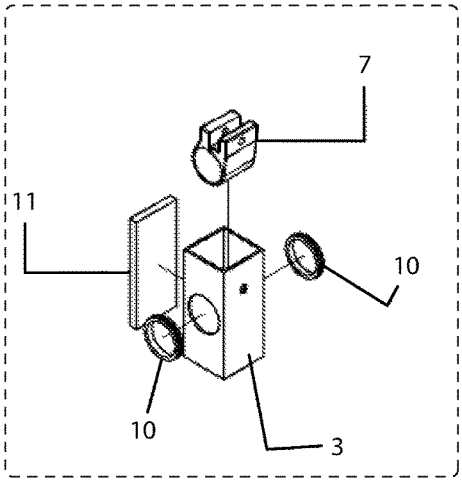
FIG. 3 depicts a detailed view of the support towers.
Figure 3A:
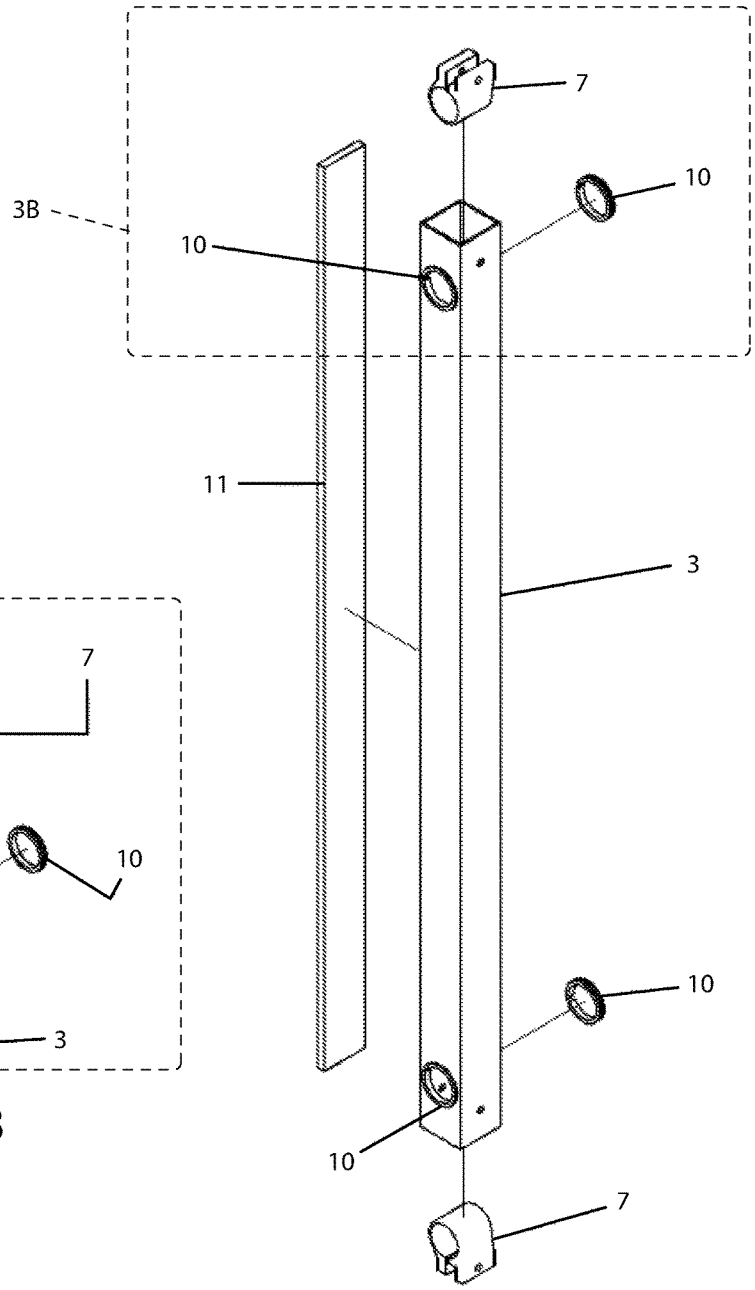
Figure 4:
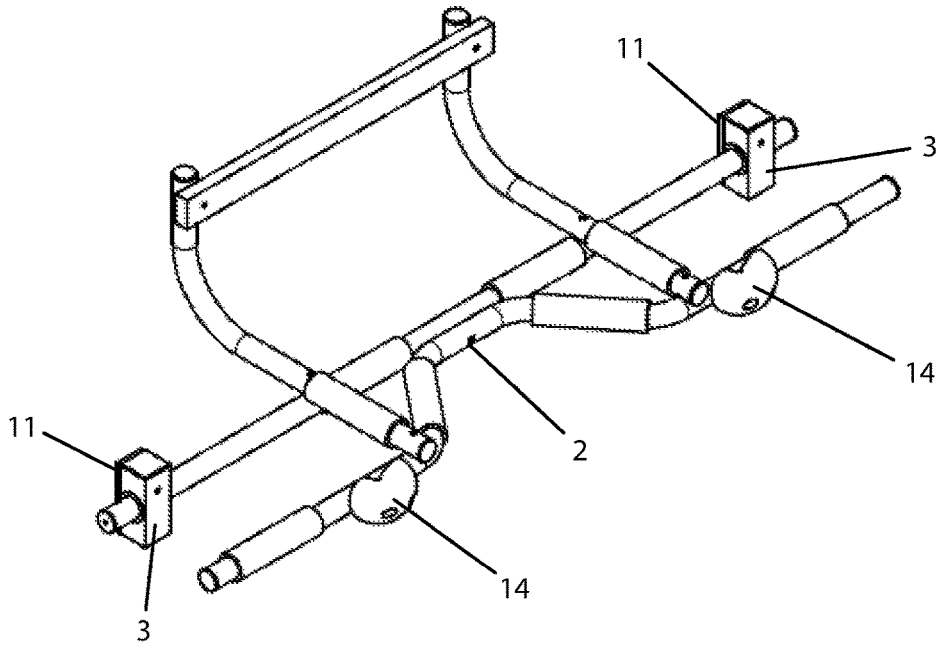
FIG. 4 depicts the exercise machine with smaller support towers to be used as a pull up bar.
Figure 5:
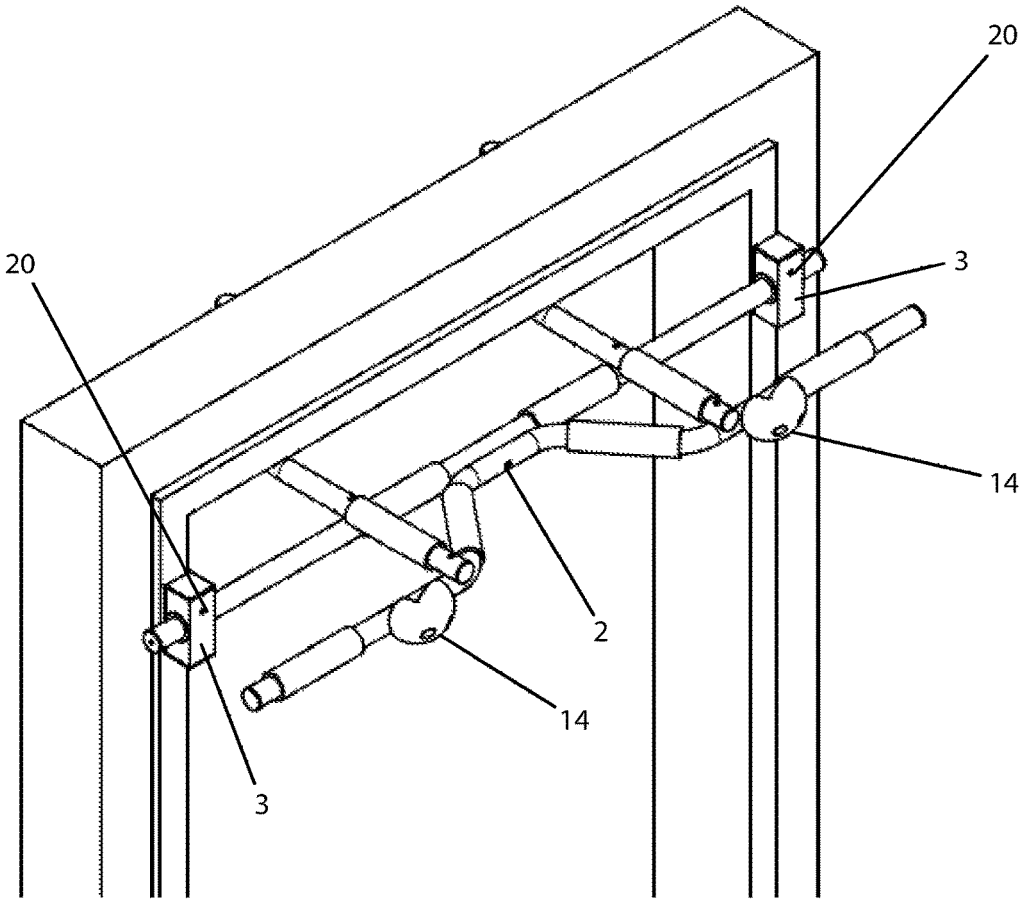
FIG. 5 depicts the exercise machine with smaller support towers on the door frame.

Referring to the Figures, a door frame 1 is generally shown in FIG. 1 and FIG. 2. A standard pull up bar 2 is attached to door frame 1. The typical pull up bar 2 consist of five pieces: a rectangular bar that runs horizontal 16 that attaches to the backside of the door frame 1 molding trim and can be secured by pressure from the user or a spring loaded hinge, two large 90 degree bars 17, mounted vertically and that are parallel, one horizontal support bar 18 that can be cylindrical that is closest to the door frame 1 but might not touch door frame 1 and that is mounted to the underside of the 90 degree bars 17, and one bar that functions as the main pull up bar 19. The pull up bar 2 preferably adjusts vertically, for example, with holes drilled on the two 90 degree bars 17 and can adjust horizontally to accommodate users of different heights and door frames 1 of different widths and thicknesses. The pull up bar 2 preferably has angled grips in the center to allow for head clearance and natural reverse grip pull up function. Pull up bar 2 can also have rock climbing grips 14 bolted to the front. The pull up bar 2 can be mounted to the support towers 3 on the horizontal bar closest to the door frame 1. The horizontal bar used for pull ups exercises on pull up bar 2 will be the anchor point for the support harnesses 4. The horizontal bar used for pull ups can have retainers to prevent the support harness 4 from slipping off during use. Pull up bar 2 can have alignment holes to preferably help adjust the support towers 3 to different door frame widths.

Support Towers

There are preferably two support towers 3. The purpose of the support towers 3 are to adjust horizontally to fit multiple door frame 1 widths and to distribute the weight of the user along the length of the door frame 1 as opposed to conventional pull up bars which typically have circular, tangent point loads. Support towers 3 are preferably made from metal rectangle tubing and can be a few inches to about three feet in length. For example, the support towers can be 2, 3, 4, 5, 6, 7, 8, 9, 10, 12, 13, 14, 15, 16, 17, 18, 19, 20, 21, 22, 23, 24, 25, 26, 27, 28, 29, 30, 31, 32, 33, 34, 35, 36, or more inches in length. Alternatively, the support towers 3 can be made of cylindrical, triangular or any number of sides piece of structural material such as wood, plastic or composite material, or the like. Support towers 3 preferably have a dampening material 11, preferably closed cell foam, attached along the entire length of the back side of support towers 3 with preferably contact cement to safely and effectively distribute the load along the length of the door frame 1. Alternatively, support towers 3 can have other dampening materials such as open cell foam, any other material in the "foam" family, rubber or cloth, or the like, and be attached by other methods common to those skilled in the art. Support towers 3 can preferably have clearance holes on both sides adjacent to the back side so that they are concentric. These concentric through holes are located near the top and bottom of support towers 3. Alternatively, the support towers 3 can only have one though hole adjacent to the back side for use with the pull up bar 2. The through holes are large enough to slide onto the bar closest to door frame 1 on pull up bar 2 and the pivot bars 6. The support towers can rotate around and slide up and down the pull up bar 2 and the pivot bars 6 so that the machine can fit different door frame 1 depth and width dimensions while maintaining flush contact or near flush contract with the door frame 1. The clearance through hole at the bottom of the support towers 3 going through the sides of the support tower 3 preferably act as a hinge point or bearing for the pivot bars 6. The bottom through holes of support towers 3 can alternatively be the size of a smaller bolt, to allow a bolted hinge point instead of a through mounted bearing style hinge point. Clamps 7 will preferably be used inside the support towers 3 to secure the support towers 3 onto the pull up bar 2 and pivot bars 6 so that they do not slide until the clamp 7 is loosened. There can be preferably a bolt sized hole on the front face of the support towers 3 for a bolt, which can have a handle, to tighten and loosen the clamp when desired. Alternatively, pins/bolts 20 can be used to go through the support towers 3 and both the pull up bar 2 and the pivot bar 6 to prevent sliding until the pin/bolt is removed. Some material such as rubber or plastic can be used as a bearing 10 between the support towers 3 and both the pull up bar 2 and the pivot bars 6 to provide smoother movement and to prolong wear. The support towers 3 can be identical and symmetrical about the horizontal and vertical center axis when viewed from the front face, which is opposite the dampening material 11 adhered to the back face.

Support Harness

The support harness 4 preferably can connect to the support harness bar 5 and the pull up bar 2. The support harness 4 is the main load bearing support for the pivot bars 6 when they are in the lowered position. Support harness 4 is preferably made out of high tensile strength, low weight, woven material such as nylon, polyester etc. Alternatively, it can be made out of any flexible high strength material such as a chain link, rope, chord or a cable of some sort, or the like. It can also be made out of ridged metal hinged together so that the pivot bars 6 can fold up and down. The support harness 4 will preferably have hoops sewn at the ends large enough to slide over the support harness bar 5 and pull up bar 2. Threaded tube inserts will preferably be used at the ends of the support harness bar 5 and pull up bar 2 closest to the support harness 4 so that a fender washer can be attached to the insert to prevent the support harness 4 from sliding off the machine during use. Alternatively, flanged, non-threaded tube inserts can be used as well. Alternatively, pull up bar 2 and support harness bar 5 can have a sleeve or high friction material attached to increase the friction on the support harness 4 to prevent slipping during use. Support harness 4 can be a fixed length or preferably adjustable for maximum user comfort, preferably using cam buckles or any other kind of length adjusting mechanism.

Support Harness Bar

The support harness bar 5 can give the support harness 4 an anchor point to attach to when the pivot bars 6 are in the lowered position and creating tension on the support harness 4. The support harness bar 5 can be secured, preferably bolted, to the pivot bars 6 with a saddle washer 8 in between to resist rotation. The support harness bar 5 can have a back pad 13 bolted to it to support the back of the user during various exercises. The support harness bar 5 can have a Velcro strap that wraps around the pull up bar 2 to secure it in its upright position.

Pivot Bars

Pivot bars 6 preferably have a general shape of a "L", in which the feet of the "L" are bolted to or inserted into the support towers 3 to create a pivoting motion as previously mentioned. Pivot bars 6 preferably fold down, pivoting from the bottom of the support towers 3 to allow users to perform additional exercises such as dips, leg raises, vertical knee raises or the like. The pivot bars 6 can also be secured by additional brackets, attachments and hardware such that the function of pivoting, or creating a hinge point, in the general area of lower portion of support towers 3 is achieved. The pivot bars 6 can preferably be secured through the support towers 3 with a clamp 7 to accommodate different width door frames 1. This can also prevent the pivot bars 6 from sliding. Optional ways to prevent the pivot bars 6 from sliding can utilize adjustment pins/bolt holes at both ends, tube collars, or high friction materials. Alternatively the pivot bars 6 can be bolted to the support towers 3 such that it only fits one standard door frame 1 width. Pivot bars 6 preferably folds up and away after use to provide a minimally obtrusive use of the doorway. Elbow pads 12 can also be attached to pivot bars 6 to provide comfort to the user during operation. The pivot bars 6 can also have handles 9 clamped to them that the user can hold to help stabilize themselves while performing exercises. The handles 9 can also preferably allow the user to slide the handles along the pivot bars 6 to provide the most desirable hand position for the user.

The various methods and techniques described above provide a number of ways to carry out the application. Of course, it is to be understood that not necessarily all objectives or advantages described can be achieved in accordance with any particular embodiment described herein. Thus, for example, those skilled in the art will recognize that the methods can be performed in a manner that achieves or optimizes one advantage or group of advantages as taught herein without necessarily achieving other objectives or advantages as taught or suggested herein. A variety of alternatives are mentioned herein. It is to be understood that some preferred embodiments specifically include one, another, or several features, while others specifically exclude one, another, or several features, while still others mitigate a particular feature by inclusion of one, another, or several advantageous features.

Furthermore, the skilled artisan will recognize the applicability of various features from different embodiments. Similarly, the various elements, features and steps discussed above, as well as other known equivalents for each such element, feature or step, can be employed in various combinations by one of ordinary skill in this art to perform methods in accordance with the principles described herein. Among the various elements, features, and steps some will be specifically included and others specifically excluded in diverse embodiments.

Although the application has been disclosed in the context of certain embodiments and examples, it will be understood by those skilled in the art that the embodiments of the application extend beyond the specifically disclosed embodiments to other alternative embodiments and/or uses and modifications and equivalents thereof.

In some embodiments, the numbers expressing measurements and so forth, used to describe and claim certain embodiments of the application are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are reported as precisely as practicable.

In some embodiments, the terms "a" and "an" and "the" and similar references used in the context of describing a particular embodiment of the application (especially in the context of certain of the following claims) can be construed to cover both the singular and the plural. The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (for example, "such as") provided with respect to certain embodiments herein is intended merely to better illuminate the application and does not pose a limitation on the scope of the application otherwise claimed. No language in the specification should be construed as indicating any non-claimed element essential to the practice of the application.

Preferred embodiments of this application are described herein. Variations on those preferred embodiments will become apparent to those of ordinary skill in the art upon reading the foregoing description. It is contemplated that skilled artisans can employ such variations as appropriate, and the application can be practiced otherwise than specifically described herein. Accordingly, many embodiments of this application include all modifications and equivalents of the subject matter recited in the claims appended hereto as permitted by applicable law. Moreover, any combination of the above-described elements in all possible variations thereof is encompassed by the application unless otherwise indicated herein or otherwise clearly contradicted by context.

All patents, patent applications, publications of patent applications, and other material, such as articles, books, specifications, publications, documents, things, and/or the like, referenced herein are hereby incorporated herein by this reference in their entirety for all purposes, excepting any prosecution file history associated with same, any of same that is inconsistent with or in conflict with the present document, or any of same that may have a limiting affect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the invention. Other modifications that can be employed can be within the scope of the application. Thus, by way of example, but not of limitation, alternative configurations of the embodiments of the application can be utilized in accordance with the teachings herein. Accordingly, embodiments of the present application are not limited to that precisely as shown and described.

What is claimed is:

1. A fitness equipment comprising left and right support towers for mounting vertically along the length of a door frame on opposite sides such that the fitness equipment is suspended above the floor or ground; and a pull-up bar structure comprising:

a support bar that runs horizontally and attaches to the backside of the door frame;

left and right parallel vertical bars attached to the support bar, wherein the vertical bars are each bent along their longitudinal axis to approximately 90 degrees;

a horizontal bar attached to the vertical bars; and a main pull-up bar attached to the vertical bars, wherein the main pull-up bar is configured to bear weight during exercise, wherein the support towers have through holes for the horizontal bar, wherein the horizontal bar is attached to the support towers, wherein the support towers are configured to rotate around and slide along the horizontal bar, and wherein the fitness equipment is configured for performing pull-up and dip exercises.

2. The fitness equipment of claim 1, wherein each of the two vertical bars has an alignment hole configured such that a pin is fit through the alignment hole to secure one of the vertical bars to the support bar.

3. The fitness equipment of claim 1, wherein the position of the two vertical bars relative to the support bar is adjustable.

4. The fitness equipment of claim 1, further comprising a dampening material affixed to each support tower on the side that is mounted to the door frame.

5. The fitness equipment of claim 1, wherein the horizontal bar and each of the support towers have alignment holes, such that a pin is fit through the alignment holes to secure the horizontal bar to the support towers.

6. The fitness equipment of claim 1, further comprising padding to protect a user during use.

7. The fitness equipment of claim 1, further comprising a support harness bar and left and right L-shaped pivot bars that are generally perpendicular to the door frame when the equipment is in use, wherein the support towers have through holes for the pivot bars, wherein the support towers can rotate around and slide along the pivot bars, wherein the support harness bar is attached to each of the pivot bars, and wherein the pivot bars and the support harness bar are configured to fold vertically when equipment is not in use.

8. The fitness equipment of claim 7, wherein each of the pivot bars has an alignment hole, such that a pin can fit through the alignment hole to secure the pivot bar to the support towers.

9. The fitness equipment of claim 7, further comprising a support harness connected to the support harness bar.

10. The fitness equipment of claim 9, wherein the support harness is connected to the main pull-up bar.

11. The fitness equipment of claim 9, further comprising a friction-increasing material attached to the support harness bar or the main pull-up bar to secure the support harnesses to the bars.

12. The fitness equipment of claim 9, wherein the support harness comprises woven material, chain link, rope, cord, or cable.

13. The fitness equipment of claim 9, wherein the support harness is connected to the top of the fitness equipment such that a load on the pivot bars is supported in tension by the support harness.

* * * * *